US008898925B2

(12) United States Patent
Zimmerman

(10) Patent No.: US 8,898,925 B2
(45) Date of Patent: Dec. 2, 2014

(54) SCENT ELIMINATING LOCKER

(76) Inventor: Jamie Zimmerman, West Branch, IA (US)

( * ) Notice: Subject to any disclaimer, the term of this patent is extended or adjusted under 35 U.S.C. 154(b) by 225 days.

(21) Appl. No.: 13/483,323

(22) Filed: May 30, 2012

(65) Prior Publication Data

US 2013/0318810 A1 Dec. 5, 2013

(51) Int. Cl.
*F26B 3/04* (2006.01)

(52) U.S. Cl.
USPC ..... 34/105; 34/201; 34/210

(58) Field of Classification Search
CPC ..... F26B 3/00; F26B 3/04; F26B 7/00; F26B 9/00; F26B 9/06; F26B 9/10; F26B 11/00; F26B 11/02; F26B 21/00; F26B 21/02; F26B 21/04; A26B 7/08; D06F 58/10
USPC ..... 34/105, 201, 210
See application file for complete search history.

(56) References Cited

U.S. PATENT DOCUMENTS 5,369,892 A 12/1994 Dhaemers
5,377,622 A * 1/1995 Lauttenbach et al. ..... 119/200
5,546,678 A * 8/1996 Dhaemers ..... 34/275
5,713,137 A * 2/1998 Fujita ..... 34/106
5,987,773 A * 11/1999 Lipscy ..... 34/106
6,263,591 B1 * 7/2001 La Porte ..... 34/622
6,878,177 B2 * 4/2005 Lohr et al. ..... 55/385.2
7,191,546 B2 * 3/2007 Maruca ..... 34/201
D552,808 S * 10/2007 Garman et al. ..... D32/8
7,913,419 B2 * 3/2011 Tomasi et al. ..... 34/595
8,119,070 B2 2/2012 Zimmerman
2003/0041572 A1 * 3/2003 Lohr et al. ..... 55/385.2
2007/0193058 A1 8/2007 Zarembinski
2013/0318810 A1 * 12/2013 Zimmerman ..... 34/82

FOREIGN PATENT DOCUMENTS

CA 2270695 A1 * 11/2000
GB 668181 * 3/1952
JP 2001128852 A * 5/2001 ..... A47J 27/16

* cited by examiner

*Primary Examiner* — Steve M Gravini
(74) *Attorney, Agent, or Firm* — Zarley Law Firm, P.L.C.

(57) ABSTRACT

A scent eliminating locker that has a housing that includes a plurality of motors disposed in an interior of the housing for circulating, moving and heating air within the interior. Additionally, in the interior of the housing there are a plurality of carbon filters that eliminates odor from tangible objects placed in the interior of the housing.

18 Claims, 1 Drawing Sheet

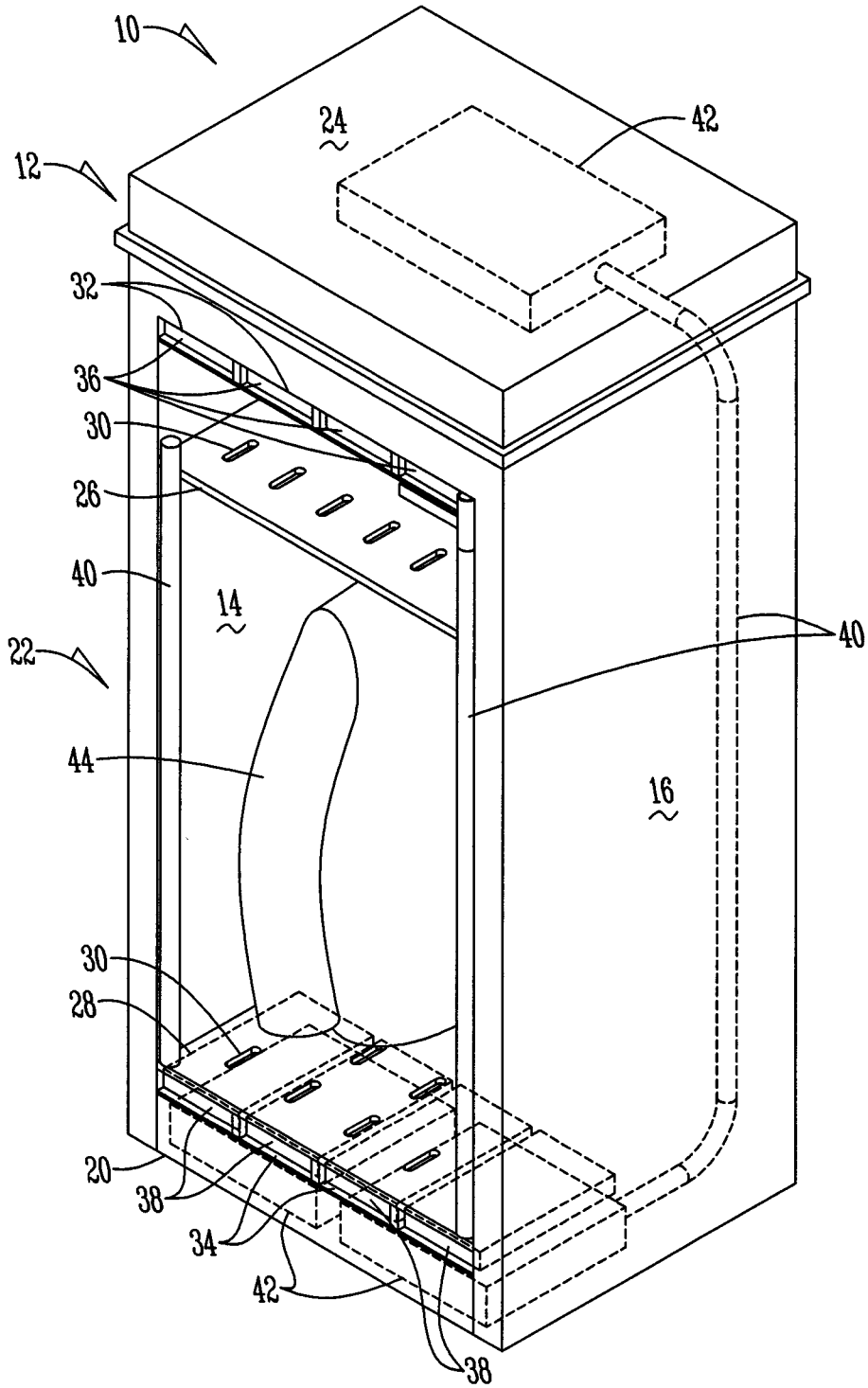
10
12
24
42
32
36
30
26
40
14
22
40
44
16
30
28
20
38
34
42
38

SCENT ELIMINATING LOCKER

BACKGROUND OF THE INVENTION

This invention relates to a scent control. More specifically this invention relates to a scent eliminating locker.

Coats, clothing, and other tangible objects over time develop an odor. In particular, while clothes can be washed after an individual wears them, coats are rarely washed. Further, sometimes clothing is worn very briefly and an individual does not desire to wash the clothing based off just a brief wearing of the item.

Unfortunately, over time clothing and coats when not washed will retain odor. In particular, over time as a result of natural body odor, sweat, dirt and the like clothing, and specifically coats, can begin to have a distinct odor. In particular, for individuals that smoke it is not unusual for a coat and clothing to retain a distinct smoke odor. This odor is unpleasant, offensive to other people, and undesirable.

Therefore, a principal object of the present invention is to provide a locker for clothing that eliminates scent.

Yet another object of the present invention is to provide a scent eliminating locker that removes smoke odor from a tangible object.

Yet another object of the present invention is to provide a scent eliminating locker that can be used to remove odor from athletic equipment as well as to provide a sterilizing affect.

These and other objects, features, and advantages will become apparent form the specification and claims.

BRIEF SUMMARY OF THE INVENTION

A scent eliminating locker that presents a housing that has a plurality of motors disposed in an interior for moving and heating air. The plurality of carbon filters are disposed within the interior of the housing to eliminate odor from tangible objects placed in the interior of the locker.

BRIEF DESCRIPTION OF THE DRAWINGS

The FIGURE is a perspective view of a scent inhibiting locker.

DETAILED DESCRIPTION OF THE PREFERRED EMBODIMENT

The figures shows a scent eliminating locker 10 that includes a housing 12 that has first and second sidewalls 14 and 16 that are in parallel spaced relation, a back wall 18 disposed therebetween and a base 20. The housing 12 is of one piece construction surrounding an interior 22. A removable lid 24 is secured to the first and second sidewalls 14 and 16 and back wall 18 of the housing 12 in order to access the interior 22 of the housing 12.

First and second perforated shelves 26 and 28 are disposed within the interior 22 of the housing 12 in parallel spaced relation such that the first perforated shelf 26 is adjacent the lid 24 and the second perforated shelf 28 is adjacent the base 20. Specifically, each of perforated shelves 26 and 28 have a plurality of openings 30 such that air can be conveyed therethrough.

First and second filter slots 32 and 34 are similarly disposed within the interior 22 of the housing 12 and receive first and second filters 36 and 38. The first filter 36 is within the first slot 32 that is adjacent the lid 24 and is positioned between the lid 24 and the first perforated shelf 26. In one embodiment the first filter is a carbon filter while in another embodiment the first filter 36 is a smoke removal filter designed specifically to remove smoke from an air space. Alternatively, a plurality of carbon filters or smoke removal filters can be placed within the first slot 32.

The second filter 38 is within the second slot 34 located adjacent the base 20 and positioned between the second shelf 28 and the base 20. The second filters 38, similar to the first filter 36, in one embodiment is a carbon filter and in another embodiment a smoke removal filter, and in another embodiment the plurality of carbon filters and in yet another embodiment the plurality of smoke removal filters. Alternatively, a combination of carbon or smoke removal filters can be utilized within either of the first and second slots 32 and 34 and represent either of the first and second filters 36 and 38.

At least one air tube 40 is disposed within the interior 22 of the housing 12 and extends from adjacent the lid 24 through the first shelf 26 through or into the second shelf 38. This air tube 40 terminates in the second shelf 38 or terminates in the air space below the second shelf 38 adjacent base 20. In this manner the air tube 40 provides an air flow communication path through the locker 10 and between the first and second filters 36 and 38. In an alternative arrangement, an air tube 40 is positioned in any corner of housing 12, as such one, two, three or four air tubes 40 are located in housing 12. In addition, it is also contemplated that an air tube is located between any two corners positioned inside of sidewalls 14, 16. These air tubes 40 serve as part of the frame of housing 12 and/or are formed within the frame of housing 12. In a preferred arrangement there are three air tubes 40 within housing 12, one positioned in each outside corner and one positioned in the middle of the housing 12. Preferably, these air tubes 40 are not clearly visible by viewing the interior of housing 12.

Also disposed within the interior 22 of the housing 12 are a plurality motors 42 that convey air and heat the air conveyed to optimize the odor removal and eliminating properties of the locker. Motors 42 are located within or adjacent to cover 24. Alternatively, motors 42 are located within or adjacent to base 20. Preferably, motors 42 are fluidly connected to air tubes 40 such that when motors 42 are activated air is pulled through air tubes 40 moving air from one side of housing 12 (the top 24 or bottom 20) to the other side of housing 12 (the top 24 or bottom 20).

Preferably, housing 12 is completely sealed therefore the air is continually circulated within the interior of housing 12. Thus, a tangible object 44 such as clothing, coat, jacket, suitcase or the like can be placed in the locker 10 to eliminate odor.

In operation, an individual places a tangible object 44 into the locker 10. Air is then conveyed and heated by the plurality of motors 42 through the perforated shelves 26 and 28 to the plurality of filters 36 and 38. The filters 36 and 38 remove smoke odor, secondary odors and the like from the tangible objects 44 such that when the tangible objects 44 are removed from the locker odor has been removed and eliminated from remaining on the tangible object 44.

Thus presented is a scent inhibiting locker that provides for a way that odor can be removed or eliminated from being on tangible objects, coats, clothing, and the like. In addition, by using moving air that is heated and the plurality of smoke removal filters and carbon filters odor on the tangible objects 44 is minimized. Thus, at the very least all of the stated objectives have been met.

What is claimed is:

1. Scent eliminating locker comprising:

a housing having a plurality of motors disposed in an interior for moving and heating air;

a plurality of carbon filters disposed in the interior of the housing to eliminate odor from tangible objects placed in the interior of the locker;

a first shelf and a second shelf positioned within the interior in parallel spaced alignment;

wherein an air tube extends through the first shelf and terminates in the second shelf to convey air through the interior of the housing.

2. The scent eliminating locker of claim 1 further comprising a plurality of smoke filters disposed in the interior of the housing.

3. The scent eliminating locker of claim 1 wherein the housing has a removable lid for accessing the interior of the housing.

4. The scent eliminating locker of claim 1 wherein the first shelf is perforated through which air is conveyed.

5. The scent eliminating locker of claim 1 wherein the second shelf is perforated.

6. The scent eliminating locker of claim 1 wherein a filter slot within the interior of the locker receives the plurality of carbon filters.

7. The scent eliminating locker of claim 1 wherein the air tube is positioned in a corner of the housing.

8. The scent eliminating locker of claim 1 wherein the plurality of motors includes a first motor positioned adjacent a cover of the housing and a second motor positioned adjacent a base of the housing.

9. Scent eliminating locker comprising:

a housing having at least one motor disposed in an interior for moving and heating air; and a plurality of air tubes fluidly connected to at least one motor.

10. The scent eliminating locker of claim 9 wherein the plurality of air tubes are positioned between the corners of a sidewall.

11. The scent eliminating locker of claim 9 wherein the plurality of air tubes are formed within a frame of the housing.

12. The scent eliminating locker of claim 9 wherein the plurality of air tubes are positioned at the outside corners and middle of the housing.

13. The scent eliminating locker of claim 9 wherein the plurality of air tubes are not visible.

14. The scent eliminating locker of claim 9 wherein the plurality of air tubes is four air tubes.

15. The scent eliminating locker of claim 9 wherein the at least one motor is positioned adjacent a cover of the housing.

16. The scent eliminating locker of claim 9 wherein the at least one motor is positioned adjacent a base of the housing.

17. The scent eliminating locker of claim 16 further comprising a first shelf and a second shelf positioned within the interior in parallel spaced alignment, wherein the plurality of air tubes extend through the first shelf and terminate in the second shelf to convey air through the interior of the housing.

18. The scent eliminating locker of claim 16 further comprising a first shelf and a second shelf positioned within the interior in parallel spaced alignment, wherein the plurality of air tubes extend through the first shelf and through the second shelf and terminate in the air space below the second shelf to convey air through the interior of the housing.

* * * * *